US007373878B2

(12) United States Patent
Finan

(10) Patent No.: US 7,373,878 B2
(45) Date of Patent: May 20, 2008

(54) DIGITAL CAN DECORATING APPARATUS

(75) Inventor: Joseph Finan, Las Vegas, NV (US)

(73) Assignee: Ball Packaging Europe Holding GmbH & Co. KG, Ratingen (DE)

( * ) Notice: Subject to any disclaimer, the term of this patent is extended or adjusted under 35 U.S.C. 154(b) by 0 days.

(21) Appl. No.: 10/570,834

(22) PCT Filed: Jul. 8, 2004

(86) PCT No.: PCT/US2004/021810

§ 371 (c)(1),
(2), (4) Date: Jan. 12, 2007

(87) PCT Pub. No.: WO2005/023545

PCT Pub. Date: Mar. 17, 2005

(65) Prior Publication Data

US 2007/0186790 A1 Aug. 16, 2007

(51) Int. Cl.
*B41F 17/08* (2006.01)

(52) U.S. Cl. ..... 101/38.1; 101/217; 101/492

(58) Field of Classification Search ..... 101/35, 101/38.1, 217, 218, 251, 492, 216; 347/103
See application file for complete search history.

(56) References Cited

U.S. PATENT DOCUMENTS

| | | | |
|---|---|---|---|
| 3,766,851 | A | 10/1973 | Sirvet et al. |
| 5,186,100 | A | 2/1993 | Turturro et al. |
| 5,677,719 | A | 10/1997 | Granzow |
| 5,743,189 | A | 4/1998 | Compera et al. |
| 5,799,574 | A | 9/1998 | Williams et al. |
| 6,178,866 | B1 | 1/2001 | Searle et al. |
| 6,367,380 | B1 | 4/2002 | Whelan |

*Primary Examiner*—Ren Yan
(74) *Attorney, Agent, or Firm*—Duane Morris LLP

(57) ABSTRACT

A digitally controlled can decorating apparatus (40) including digitally controlled print heads (50) arrayed around the blanket cylinder (20) of an offset type decorating apparatus for delivering ink in a selected pattern from each print head (50) to each blanket section (17) of the blanket cylinder (20), and the blanket cylinder sections (17) thereafter transferring the ink to the cans (22) being decorated.

20 Claims, 2 Drawing Sheets

DIGITAL CAN DECORATING APPARATUS

BACKGROUND OF THE INVENTION

1. Field of the Invention

The present invention relates to decorating apparatus for decorating an object, particularly, a circular object, and in a particular application, for decorating a can, and particularly to a digital can decorating apparatus for digitally controlled printing on two-piece cans. Although the disclosure herein describes the invention as applied to decoration of cans, the invention is applicable to decorating any object, and particularly a generally cylindrical or round object which is adapted to be supported, and particularly rotated, in opposition to a blanket segment that has been printed by a digitally controlled device.

2. The Prior Art

Conventionally, two-piece cans are decorated by offset printing. In such a process each color ink is contained in a separate inking station that transfers the ink to a printing plate. The ink on the plate is transferred to spaced apart blanket section of a printing blanket that is rotated past all the inkers. The complete patterns of inks are then simultaneously applied from each blanket section to the can then in register with that inked section of the blanket. If a different image is desired to be printed, or a change is desired in the image, it is necessary to change each printing plate of each inker, which plate transfers to the blanket a particular image and color which has been assigned to that inker. When the ink color provided at an inking station is to be changed, the ink distribution rolls of the inker must be cleaned to avoid contamination of the new color by the previous color. A representation of such a known device, including conventional inkers, is shown in FIG. 1.

Further examples of similar can printing devices are shown in U.S. Pat. Nos. 3,766,851, 5,799,574 and 6,367,380. U.S. Pat. No. 5,799,574 discloses a relatively high speed apparatus for applying decorations to the exterior of cylindrical containers while they are mounted on mandrels which are disposed along a periphery of a large continuously rotating disk carrier. Decorations are applied to the containers as they engage a rotating blanket of a decorator that is adjacent the periphery of the carrier. During engagement between the containers and the blanket, the containers track the blanket surface through the printing region where the containers and the blanket surface are engaged.

This type of decorating equipment includes a number of relatively heavy elements that move at high speed.

Major components of this decorating apparatus comprise separate inkers, at least one for each ink color. Each inker is comprised of an ink supply followed by a series of ink distribution rollers, as in U.S. Pat. No. 6,367,380; and 5,186,100 or other ink distribution designs within an inker, as in U.S. Pat. No. 6,367,380. Each inker is heavy and complicated as it is comprised of many elements. Because there must be precise coordination between the various elements, inertia forces and operating power are significant engineering design considerations, as are equipment down time, maintenance, cost and setup procedures.

Digital printing is used in many environments. Digital printing might be broadly defined as printing without use of printing plates. An example of digital printing is ink jet printing, of which there are several different techniques, including the use of a piezo element to apply pressure to a nozzle chamber to force a drop of ink onto a medium, continuous ink supply with required ink droplets channeled onto the medium, thermal printing where a gas bubble in a nozzle chamber creates pressure forcing an ink droplet onto the medium, or ink in solid form is melted as needed and then applied like a liquid ink jet. Ink might be sprayed by a spray jet. Other non-plate techniques of applying ink include thermal wax or resin tracer, dye sublimation, etc. Use of a particular technique of digital printing is not required for performance of the present invention. Ink jet printing overrides the various steps and apparatus associated with producing, mounting and setting printing plates and avoids need for conventional inkers and avoids having to clean distribution rollers of the conventional inkers.

Apparatus for adapting the digital printing technique to decorating of cans or containers, and of the type of the present invention, have not previously been disclosed.

SUMMARY OF THE INVENTION

Accordingly, it is an object of the present invention to provide an apparatus for printing of images on objects, particularly round objects, more particularly cans and specifically two-piece cans, which apparatus, relative to the prior art, is mechanically simpler and uses fewer parts. Decoration of cans is described herein as one application of the apparatus. Pursuant to this object, and others which will become apparent hereafter, the present invention provides apparatus for digitally controlled printing directly on the printing blanket without the need for conventional inkers including their series of rolls and printing plate.

The inventive apparatus includes means for digitally and electronically controlling the timing and configuration of a colored image applied on the printing blanket, which blanket then transfers the ink image to a can surface. Such digitally controlled means may include any known type of non-contact print-head, such as an ink jet print-head. The rotating blanket cylinder has a plurality of blanket sections around its periphery which are so spaced apart that coordinated rotation of the blanket cylinder adjacent the carrier which is moving containers past the blanket cylinder causes each blanket section to print an image on a container. Furthermore, the inventive apparatus may include other known elements of a can or container decorating apparatus, such as is shown in the above-noted patents, like U.S. Pat. No. 5,799,574, incorporated herein by reference.

A computer controls the continuous rotation of the blanket cylinder as well as the continuous rotation of the can carrier and coordinates the arrivals of the blanket sections to be inked in front of each of the print-heads. Digital control of the individual print-heads may also be performed by the same computer. This computer control allows flexibility in the control of the printing apparatus itself as well as in the ability to instantaneously change the image being printed.

A support is provided for holding the print-heads so that their non-contacting ink outlets are directed toward the blanket sections to be printed.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described therein.

DESCRIPTION OF THE PREFERRED EMBODIMENT

The preferred embodiment is described for decorating on cans. But that is only one application of the invention. The invention can be used to decorate any objects that are moved relative to print blankets, especially circular objects or other objects, including any containers.

Figure 1:
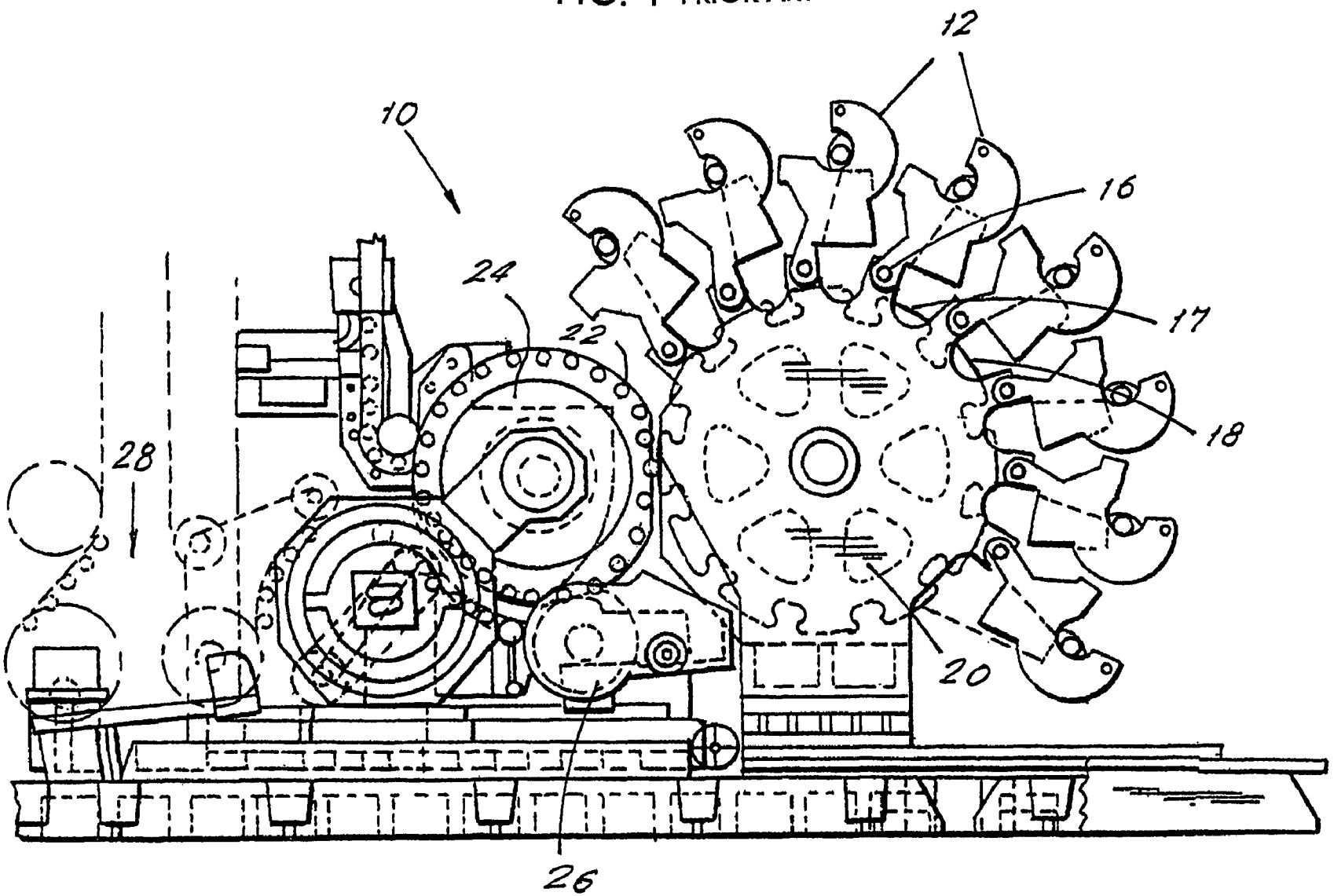
FIG. 1 PRIOR ART
FIG. 1 is a side view of a prior art offset printing apparatus.

The state of the art of decorating cans, e.g. two-piece image cans, is disclosed in prior art, such as above-mentioned U.S. Pat. No. 5,799,574. The relevant portions of such prior art apparatus is seen in FIG. 1 hereof where the printing apparatus 10 includes a plurality of inkers 12, each for supplying a particular ornamental pattern component in one color. Eight inkers 12 are shown, allowing printing of up to eight different patterns and/or eight different colors. The inkers include an ink receiving section and the ink is transmitted radially inwardly along a series of inking rolls to the plate cylinders 16 which transfer the image in a particular color from each of the inkers to a respective section 17 of the inking blanket 18 on the blanket wheel 20. Examples of inkers with a series of rolls are seen in U.S. Pat. Nos. 6,367,380 and 6,178,886.

The blanket wheel 20 rotates in one direction, here counterclockwise, bringing each inked section 17 in turn against the surface of a respective can 22 being carried around on a respective mandrel on the mandrel wheel 24, so that the image printed on each blanket section 17 is received from the operative ones of the inkers 12 and the image is transferred to the cans 22. After being printed, the cans are sent for subsequent treatment in the usual manner, e.g. over-varnishing at 26, curing at 28, etc. The invention enables avoidance of the need for inkers 12.

Figure 2:
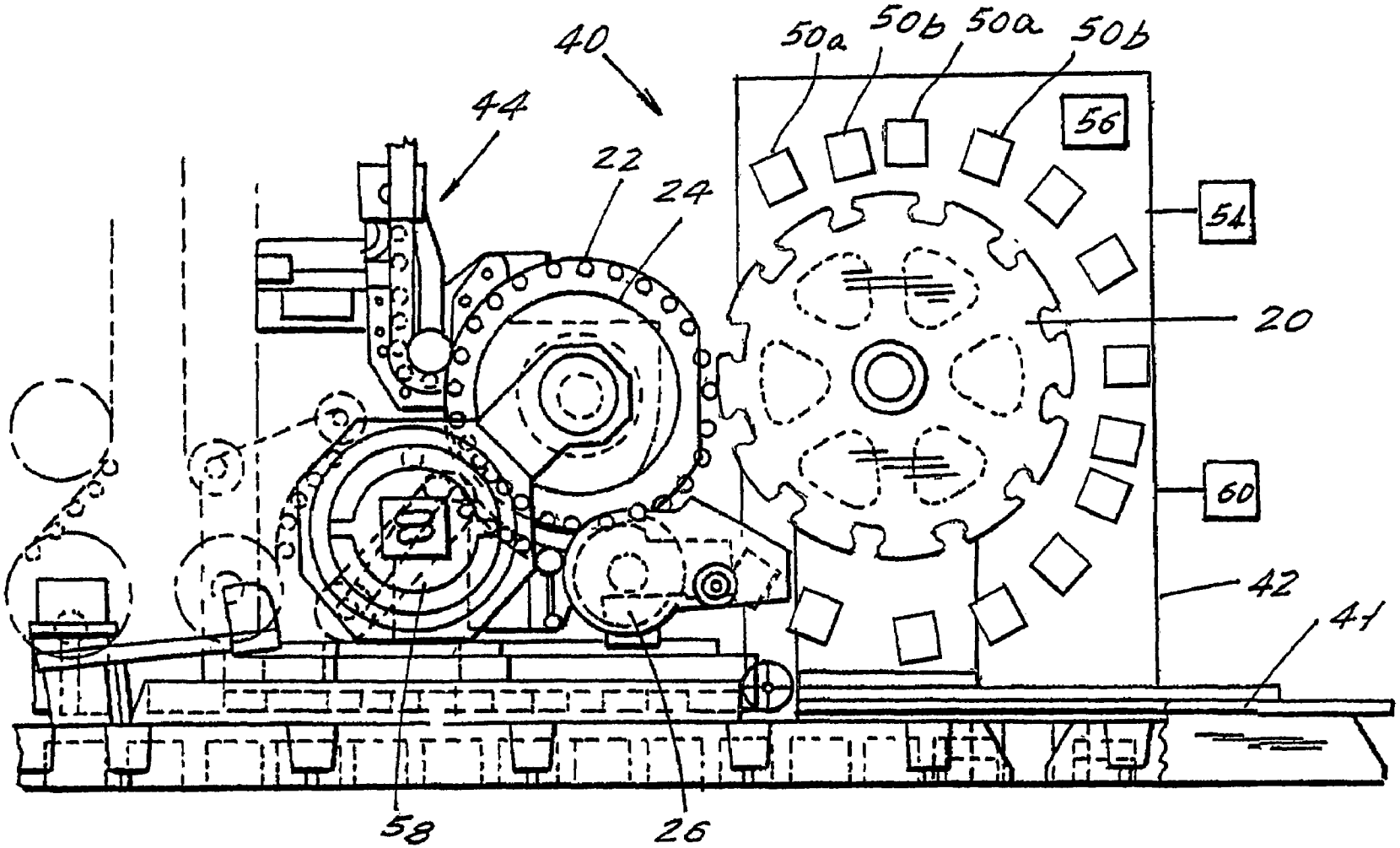
FIG. 2 is a side view of the inventive decorating apparatus.

FIG. 2 generally and schematically shows a digital print-head apparatus 40 for decorating cans, according to the invention. In place of each of the inkers 12 of the prior art which is shown in FIG. 1, for example, FIG. 2 shows the apparatus 40 including a base 41 on which stands a print-head support 42.

A conventional in-feed station 44 for the cans 22 comprises a supply chute which delivers the cans 22 for being drawn onto mandrels on the wheel 24 by suction.

A plurality of digital print-heads 50 are arrayed around an arcuate part of the circular path of the blanket wheel 20. Each print-head 50 is a digital print-head of a known type which delivers a particular color ink in a preselected digitally controlled pattern to the blanket cylinder blanket section 17 that is then radially aligned with or at the particular print-head ink outlet. In the illustrative example in FIG. 2, fourteen print-heads 50 are shown. But the number of print-heads on a support 42 is a matter of choice. Providing fourteen digital print-heads makes it possible to print up to that number of different ink colors and/or different patterns or to print several repeats of the same colors or patterns, e.g. a four color printing of cans may permit three separate repetition printing patterns to be printed in one rotation of mandrels past twelve activated print-heads. Conventional controls 54 sense the locations of the blanket sections 17 with respect to the print-heads 50, and activate the print-heads at the appropriate times for printing the selected color and pattern on the blanket section.

One or more reservoirs 56 of ink for the digital print-heads is provided on the print-head support 42 and is connected to the print-head support for supplying ink as required to each of the print-heads.

Following the printing, the printed cans are moved by rotation of the can carrier to be varnished at the varnishing station 26. Thereafter, the mandrels arrive at the transfer station 58, and the individual now decorated and varnished cans are transferred by the conventional mandrel operating system to transfer elements at the transfer station which then carry the decorated cans to further treatment in the usual manner.

A separate digitally controlled electronic print engine or head 50*a*, 50*b*, 50*c*, etc. is provided for each color ink. Each head prints its respective color ink directly to the blanket section 17 passing the respective print-heads 50. The print-heads in the present embodiment are similar to ink jet print-heads used in computer printers. Any appropriate size and configuration digitally controllable print head able to apply ink to a surface, and preferably a non-contact print head, may be used.

Print-head printing control information is provided from a control unit, such as a computer 60. This control allows the image being printed to be easily changed by merely programming the desired image into the computer. The programming instructs the print-heads on the precise printing job to be performed by each print-head. Typically, the pattern to be printed by the print head is changed. But with appropriate connections to supplies and reservoirs of various ink colors, each print head may change not only the pattern, but also the color it prints, changing either one or both of these characteristics. This avoids the need for changing printing plates, as is necessary in the offset printing apparatus of the prior art. It also avoids machine wear, printing pressure supply and support, and printing plate replacement, and possible wear thereof, all occurring in known contact printing. Furthermore, with the present invention, it is even possible to print multiple images on several alternating cans due to the individual control of the print-heads and the non-contact printing of the blanket segments.

Use of the digitally controlled print-heads enables quickly changing the image being printed by reprogramming the computer control. If desired, successive blanket sections can be provided with different images, or with the same images in different colors without having to stop the printing apparatus or change printing plates. If desired, it is also possible to print with only selected ones of the print-heads and not all of the print-heads of the apparatus operating.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A digital printing apparatus for printing on objects, said apparatus comprising:

a moveable blanket carrier having an exterior on which a printing blanket is disposed, the printing blanket having a plurality of blanket sections along the exterior of the carrier, with each blanket section being so placed along the carrier and being of such length as to transfer ink on the blanket section to a respective object to be printed which moves in contact with the respective blanket section;

digitally controlled print heads arranged in a spaced apart relation along at least a portion of a path of the printing blanket and operative to print at least a single color in patterns and the print heads are directed so as to provide non-contact digitally controlled printing of a blanket section moved past the print heads by the blanket carrier;

wherein several repeats of said at least one color are printed by said spaced apart digital print heads;

an object transport device for transporting objects to be printed by contact with respective blanket sections of the blanket carrier after the print heads have printed the blanket section, the transport device including a plurality of supports for the objects to be printed, the supports being spaced apart on the transport device, the transport device being so shaped and being so positioned with respect to the blanket carrier as to move each object supported thereon in turn past a respective blanket section and in contact with the blanket sections sufficiently for enabling transfer of an ink image on the respective blanket section to the respective object then in contact with the blanket section, the transport device then transporting each object printed by a respective blanket section away from the blanket carrier for further processing.

2. The printing apparatus of claim 1, wherein the carrier comprises a blanket cylinder and the movement of the carrier comprises rotation thereof.

3. The printing apparatus of claim 2, further comprising a plurality of the digitally controlled print heads spaced apart along the carrier and respectively positioned and aimed at the blanket cylinder, so that the plurality of print heads are operable to print a plurality of the blanket sections, as a blanket section to be printed by a respective print head passes the respective print head.

4. The printing apparatus of claim 3, further comprising a computer control connected with the print heads and with the blanket carrier for sensing the position of the blanket carrier and the blanket sections thereon and for selectively operating each print head to print the blanket section then passing the print head.

5. The printing apparatus of claim 3, further comprising a varnishing device positioned after the contact between the objects being printed and the blanket cylinder for varnishing the objects after printing.

6. The printing apparatus of claim 5, further comprising a transfer device for transferring the objects off the transport device after varnishing.

7. The printing apparatus of claim 3, wherein the print heads are ink jet print heads.

8. The printing apparatus of claim 7, further comprising an ink reservoir connected with the print heads for supplying inks to the print heads.

9. The printing apparatus of claim 1, further comprising a plurality of the digitally controlled print heads spaced apart along the carrier and respectively positioned and aimed at the blanket carrier, so that the plurality of print heads are operable to print a plurality of the blanket sections, as a blanket section to be printed by a respective print head passes the respective print head.

10. The printing apparatus of claim 9, further comprising a computer control connected with the print heads and with the blanket carrier for sensing the position of the blanket carrier and the blanket sections thereon and for selectively operating each print head to print the blanket section then passing the print head.

11. The printing apparatus of claim 9, wherein the print heads are ink jet print heads.

12. The printing apparatus of claim 11, further comprising an ink reservoir connected with the print heads for supplying inks to the print heads.

13. The printing apparatus of claim 9, further comprising a transfer device for transferring objects off the transport device after printing by contact with the blanket section.

14. The printing apparatus of claim 9, further comprising a varnishing device positioned after the contact between the objects being printed and the blanket carrier for varnishing the objects after printing.

15. The printing apparatus of claim 14, further comprising a transfer device for transferring the objects off the transport device after varnishing.

16. A printing method for moved objects, the method comprising:

moving a printing blanket having a plurality of blanket sections past a plurality of digital print heads so positioned and arranged along at least a portion of a path of the blanket sections and printing at least a single color in patterns, directing the print heads so as to enable all the print heads to provide non-contact printing of a blanket section then moving past the print heads;

operating the print heads to provide at least the single color in patterns to at least selected ones of the blanket sections moving past the print heads and receiving a plurality of repeats of the patterns in said at least one color;

moving each object to be printed into contact with one of the blanket sections sufficiently for enabling transfer of an ink image on the respective blanket section to the respective object then in contact with the blanket section; and moving each object printed by a blanket section away from the blanket.

17. The printing method of claim 16, further comprising moving the printing blanket and the sections thereof along a circular pathway by rotating the blanket.

18. The printing method of claim 16, further comprising operating the print heads to control at least one of the color and the pattern printed by the print head between different printing operations by the print heads.

19. The printing method of claim 16, further comprising transferring objects for further processing after the printing thereof by the blanket section.

20. The printing method of claim 16, further comprising varnishing the objects after the printing thereof.

* * * * *